US005841461A

United States Patent [19]

Katsuma

[11] Patent Number: 5,841,461

[45] Date of Patent: Nov. 24, 1998

[54] ACCUMULATED HEAT CORRECTION METHOD AND APPARATUS

[75] Inventor: Nobuo Katsuma, Saitama, Japan

[73] Assignee: Fuji Photo Film Co., Ltd., Kanagawa, Japan

[21] Appl. No.: 698,695

[22] Filed: Aug. 16, 1996

[30] Foreign Application Priority Data

Aug. 17, 1995 [JP] Japan ..... 7-209779

[51] Int. Cl.[6] ..... B41J 3/20

[52] U.S. Cl. ..... 347/195; 347/188; 347/194; 400/120.09; 400/120.14

[58] Field of Search ..... 347/174, 175, 347/180, 183, 188, 194, 195; 400/120.09, 120.14, 120.15

[56] References Cited

U.S. PATENT DOCUMENTS 4,574,293 3/1986 Inui et al. ..... 347/196
4,827,279 5/1989 Lubinsky et al. ..... 347/188
5,339,099 8/1994 Nureki et al. ..... 347/180
5,424,761 6/1995 Imai ..... 347/212
5,633,671 5/1997 Watanabe ..... 347/192

*Primary Examiner*—Nancy Le
*Assistant Examiner*—Anh T. N. Vo

[57] ABSTRACT

Accumulated heat correcting data of an Nth line to be printed is subtracted from original heat data of the Nth line. This corrected heat data of the Nth line is supplied to a head driver which drives a thermal head to record dots of one line on a recording sheet. The corrected heat data of the Nth line is multiplied by a coefficient K1 to obtain first data. The first data is added to the accumulated heat correcting data of the Nth line, and sum data of the addition is written in a line memory as second data. In printing the (N+1)th line, the second data is read from the line memory. The second data is multiplied by a coefficient K2 to obtain the accumulated heat correcting data of the (N+1)th line, which is used for accumulated heat correction of the original heat data of the (N+1)th line.

7 Claims, 3 Drawing Sheets

ACCUMULATED HEAT CORRECTION METHOD AND APPARATUS

BACKGROUND OF THE INVENTION

1. Field of the Invention

The present invention relates to an accumulated heat correction method and apparatus used with a thermal printer for preventing an image quality from being degraded by accumulated heat of a heating element.

2. Description of the Related Art

There are a thermosensitive recording type thermal printer and a thermal transfer recording type thermal printer. The former heats a thermosensitive recording sheet with a thermal head to directly develop color, and the latter heats the back side of an ink ribbon placed upon a recording sheet to transfer ink in the ink ribbon to a recording sheet. A thermal head has a number of heating elements disposed on a ceramic substrate.

With the thermosensitive recording method or the thermal transfer recording method of a sublimation type, each heating element is driven in accordance with input image data and a dot having a desired density is printed on a recording sheet. If the input image data is used directly, dispersion of densities is generated in a printed image or the contour thereof becomes indefinite, because of the influence of accumulated heat.

Most of heat energy generated by each heating element is used for recording, and heat energy not used for recording is accumulated or dissipated. Heat accumulation can be classified into local heat accumulation (hereinafter called heat accumulation of a heating element) and overall heat accumulation (hereinafter called heat accumulation by a thermal head).

Heat energy generated by a heating element is mainly accumulated in the glaze layer of the heating element. The amount of accumulated heat energy depends on the past heating state of the heating element, i.e., on the heating history. In addition to accumulated heat energy by a heating element, part of heat energy accumulated by adjacent heating elements may be transferred.

Part of the heat energy accumulated in a heating element contributes to recording a pixel. Therefore, the coloring density of this pixel becomes higher than an expected value. Therefore, even if an original image has an area in which the density changes greatly from high to low, this area printed on a hard copy has a gentle change in density. The contour of an image cannot therefore be printed sharply.

Part of the heat energy generated by each heating element is transferred to the ceramic substrate or to an aluminum plate supporting the substrate, and accumulated therein. Thermal head heat accumulation causes the density dispersion of a whole image, called shading. With this shading, the area at the start of recording has generally a low density, and as the recording proceeds, the density becomes high as a whole. Thermal head heat accumulation has been corrected by adjusting a voltage applied to the thermal head in accordance with a temperature measured with a temperature sensor mounted on the thermal head.

For heating element heat accumulation, heat data of a subject pixel as designated is corrected through filtering calculation of heat data of pixels adjacent to the subject pixel, e.g., heat data of 3×3 or 7×7 pixels. This filtering calculation is the same approach as a known edge enhancing process. Pixel data of each adjacent pixel is multiplied by a coefficient which depends on the position thereof, and the multiplied pixel data of all adjacent pixels is added. This addition value is used as correction data and added to the heat data of the subject pixel.

The edge enhancing process makes a high density of a pixel higher and a low density of a pixel lower to increase the contrast. The filtering calculation is used for reproducing an original image with high fidelity by eliminating the influence of a past heating state, and does not intend to increase a contrast.

Although these image processing processes use different coefficients depending on the object of each process, they use the same calculation equations.

The filtering calculation adjusts heat data while taking heating history from several lines before into consideration. In order to eliminate the influence of heating element heat accumulation with more efficiency, heating history of a larger range of the larger than time is required to be considered. However, heating history of the larger range results in an increased number of heat data sets to be used by the calculation and in an increased number of line memories and calculation units. This leads to high cost and a delay time of calculations and it is practically difficult to realize such a system.

SUMMARY OF THE INVENTION

It is a principal object of the present invention to provide an accumulated heat correction method and apparatus capable of reliably correcting accumulated heat by taking heating history of a longer time into consideration.

It is another object of the present invention to provide an accumulated heat correction method and apparatus of a simple configuration and with a high speed calculation even for heating history of a longer time.

In order to achieve the above and other objects, in the accumulated heat correction method of this invention, accumulated heat correcting data of an Nth line is subtracted from original heat data of the Nth line in dot-to-dot correspondence, to correct the original heat data of the Nth line. A thermal head is driven by the corrected heat data of the Nth line to record an image on a recording sheet. The corrected heat data of the Nth line is multiplied by a coefficient K1 and added to the accumulated heat correcting data of the Nth line in dot-to-dot correspondence.

Next, a sum of the addition is multiplied by a coefficient K2 to obtain the accumulated heat correcting data of the (N+1)th line.

This accumulated heat correcting data of the (N+1)th line is used for accumulated heat correction of the original heat data of the (N+1)th line.

According to a preferred embodiment of the invention, in calculating the accumulated heat correcting data of the (N+1)th line, the accumulated heat correcting data of the Nth line is subjected to a filtering calculation. This filtering calculation uses five sets of accumulated heat correcting data including subject accumulated heat correcting data, two sets of accumulated heat correcting data at two positions at a right side, and two sets of accumulated heat correcting data at two positions at a left side. Two sets of the accumulated heat correcting data at the first positions at the right and left sides are multiplied by a coefficient K3, and two sets of the accumulated heat correcting data at the second positions at the right and left sides are multiplied by a coefficient K4. These five sets of the accumulated heat correcting data are added together to obtain new subject accumulated heat correcting data.

According to the present invention, accumulated heat correction can be performed by using a small capacity of a memory and a simple calculation circuit, while taking the heating history of a larger range into consideration. Since the filtering calculation is performed for the accumulated heat correcting data, reliable accumulated heat correction can be performed while considering heat accumulation of adjacent heating elements.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENTS

Figure 1:
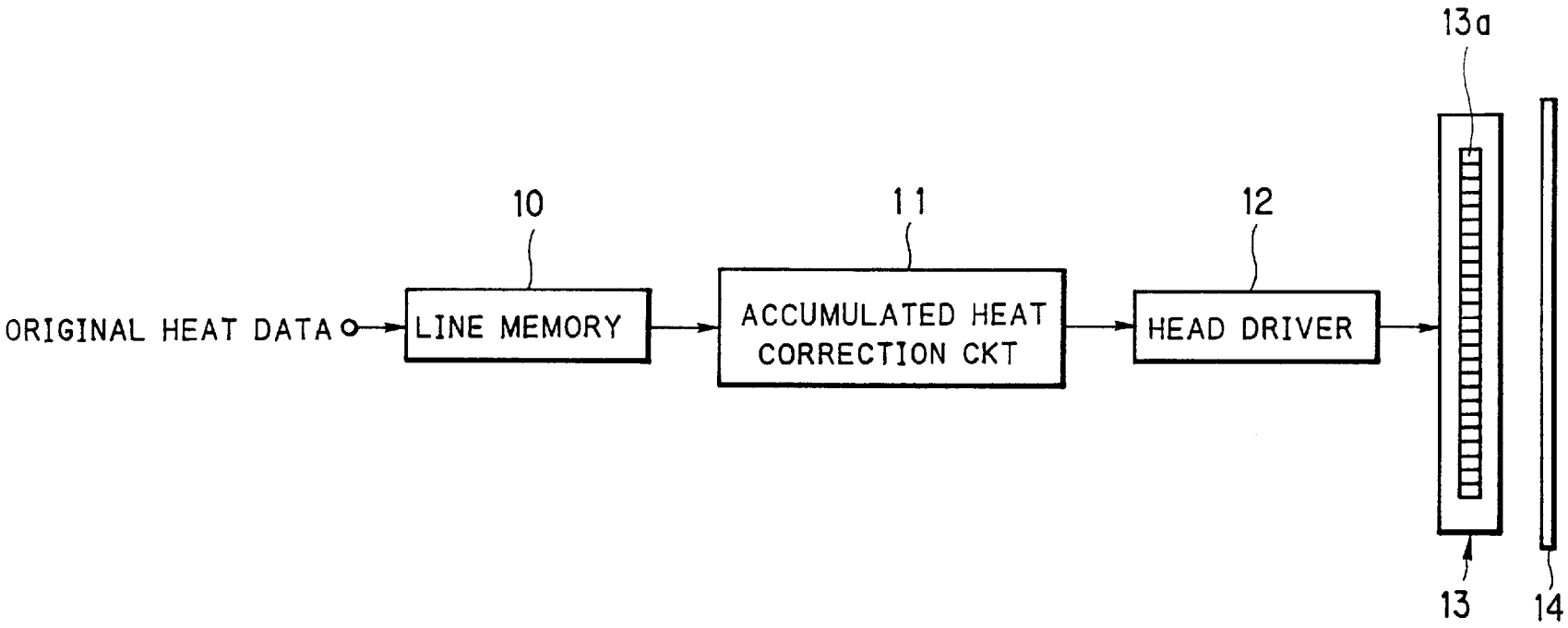
FIG. 1 is a schematic diagram of a thermal printer embodying accumulated heat correction of this invention.

Referring to FIG. 1, original heat data of one line is written in a line memory 10. With the thermosensitive recording method, in recording one dot with an heating element, a bias heating and an image or gradation heating are sequentially performed. The bias heating heats a heating element to an amount directly before coloring, and the image heating heats the heating element in accordance with a coloring density. For the bias heating, all heating elements are uniformly heated by bias data. The bias data is basically the same for all heating elements. However, if there is any dispersion in resistance values or the like of heating elements, the bias data of each heating element is determined while considering this dispersion of resistance values or the like. The gradation heating drives each heating element in accordance with image data. The thermosensitive recording method therefore uses both the bias data and image data as the heat data. Since the thermal transfer recording performs only the gradation heating, the heat data corresponds to the image data.

The original heat data of one line stored in the line memory 10 is sent to an accumulated heat correction circuit 11 to correct accumulated heat. In the thermosensitive recording method, both the image data and bias data, or one of them, may be subjected to accumulated heat correction. The accumulated heat corrected heat data is sent to a head driver 12. This head driver 12 drives a thermal head 13 which is in pressure contact with a thermosensitive recording sheet 14 which moves in the direction perpendicular to the drawing sheet as viewed in FIG. 1.

As well known, the thermal head 13 has a number of heating elements 13*a* disposed in line on a ceramic substrate. This ceramic substrate is fixedly mounted on an aluminum plate. The aluminum plate is integrally formed with a plurality of fins (not shown) in order to improve heat dissipation.

Each heating element 13*a* of the thermal head 13 generates heat energy corresponding to heat data. There are two methods of driving a heating element, one method determining an on-time in accordance with heat data and the other method determining the number of heating times in accordance with heat data.

Figure 2:
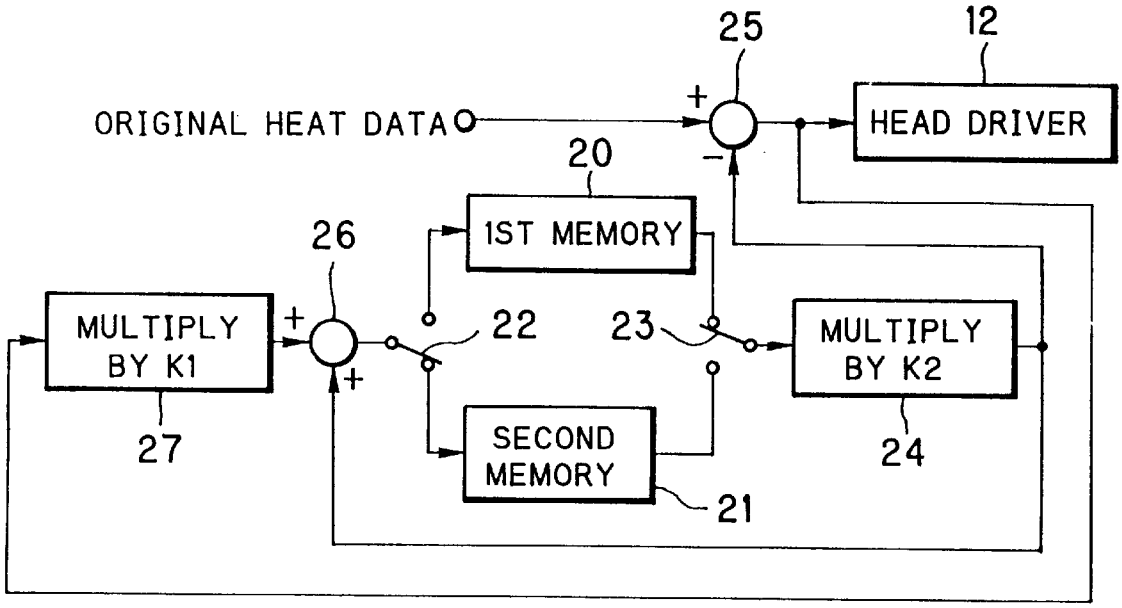
FIG. 2 is a block diagram showing an example of an accumulated heat correction circuit.

FIG. 2 is a block diagram showing an example of the accumulated heat correction circuit 11. Heat data of one line representative also of heating history of the heating elements is written in first and second line memories 20 and 21. These line memories 20 and 21 are alternately switched by switches 22 and 23 between reading and writing heat data. In the state shown in FIG. 2, data of one line stored in the first line memory 20 is sequentially read and sent via the switch 23 to a multiplier 24.

The multiplier 24 multiplies sequentially input data by a coefficient K2. The data multiplied by the coefficient K2 is sent to summing points 25 and 26 as accumulated heat correcting data. At the summing point 25, original heat data of one line to be printed is sequentially input. The accumulated heat correcting data is subtracted from the original heat data. Corrected heat data of one line obtained by the subtraction process of accumulated heat correction is sent to the head driver 12.

The corrected heat data of one line is multiplied by a coefficient K1 by a multiplier 27 and sent to the summing point 26. At this summing point 26, the data multiplied by the coefficient K1 is added to the accumulated heat correcting data. This addition data is written via the switch 26 into the second line memory 21 as data representative of heating history.

Prior to printing the next line, the switches 22 and 23 are switched to read data from the second line memory 21. This data is multiplied by the coefficient K2 and sent to the summing points 25 and 26 as the accumulated heat correcting data. In the similar manner to the above, the first and second line memories 20 and 21 are alternately read and written.

In this embodiment, corrected heat data of the Nth line is weighted by the coefficient K1 and added to the accumulated heat correcting data of the Nth line, and the addition data is written in the line memory as the data representative of heating history. In printing the next line, the data is read from the line memory and weighted by the coefficient K2 to obtain the accumulated heat correcting data of the (N+1I)th line.

The accumulated heat correcting data for the newer line is weighted more than the older line and subtracts the heat data. Therefore, the accumulated heat corrected data can be obtained while considering the heating history, i.e., the degree of accumulated heat. Even for the accumulated heat correcting data for the older line, the heating history is taken into consideration to generate the accumulated heat correcting data so that the heat accumulation condition of the heating elements can be predicted correctly.

The coefficient K1 is determined in accordance with the shape of the thermal head, the length of each heating element, the quality of a thermosensitive recording sheet, and the like. The coefficient K2 is determined in accordance with the shape, cooling state, and the like of the thermal head. Generally, the coefficient K1 is 0.3 to 0.5. The coefficient K2 is 0.5 to 0.8, and if the cooling state is good, a value near "0" is used, whereas if the cooling state is bad, a value near "1" is used.

Since the coefficient K2 is smaller than 1, the weight of the heat data is gradually reduced for the older print line.

Figure 3:
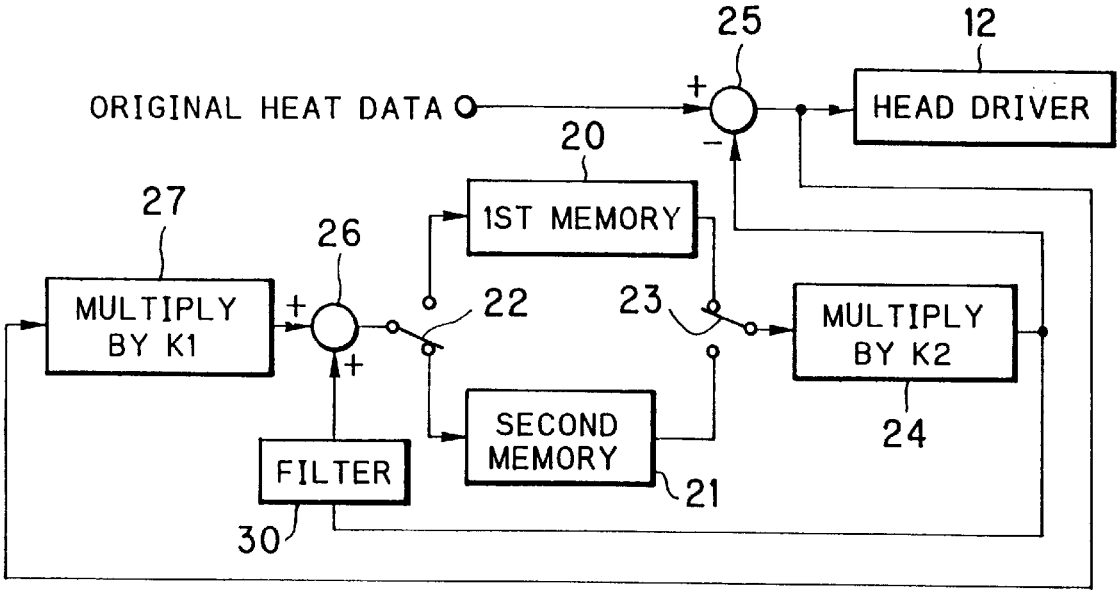
FIG. 3 is a block diagram showing another example of the accumulated heat correction circuit which takes also accumulated heat in adjacent heating elements, according to an embodiment of the invention.

Image quality degradation by heat accumulation is most influenced by the heat accumulation of the heating element itself. However, heat accumulation in adjacent heating elements also degrades the image quality. FIG. 3 shows another accumulated heat correction circuit which generates the accumulated heat correcting data while considering the heat energy accumulated in adjacent heating elements. In this circuit shown in FIG. 3, the previous accumulated heat correcting data is subjected to a filtering process by a filter 30 in order to consider the influence of heat accumulation of adjacent heating elements, and thereafter sent to the summing point 26.

Figure 4:
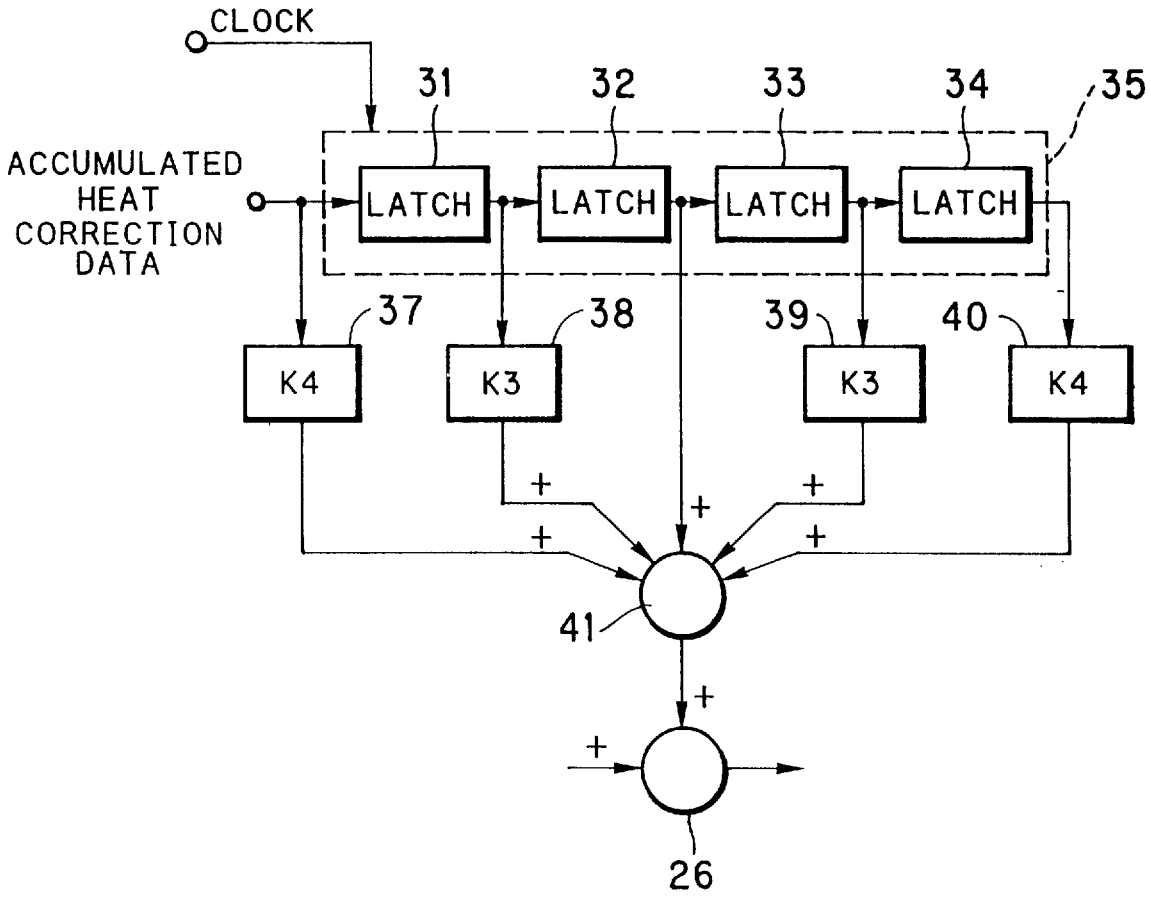
FIG. 4 is a block diagram showing an example of a filter.

An example of the filter is shown in FIG. 4. The previous accumulated heat correcting data is sent to a shift register 35 which is constituted by four cascade-connected latch circuits 31 to 34 for shifting the accumulated heat correcting data in response to a clock. Two sets of the accumulated heat correcting data derived from the input and output terminals of the latch circuit 31 are sent to multipliers 37 and 38. Two sets of the accumulated heat correcting data derived from the input and output terminals of the latch circuit 34 are sent to multipliers 39 and 40. The multiplication results by the multipliers 37 and 38 and the accumulated heat correcting data latched by the latch circuit 32 are added at a summing point 41 and the addition result is sent to the summing point 26 shown in FIG. 3. Another latch circuit may be connected before the latch circuit 31 to send the accumulated heat correcting data latched by this latch circuit to the multiplier 37.

Data of one line stored in one of the line memories 20 and 21 is sequentially read starting from one end of the line, multiplied by the coefficient K2 by the multiplier 24 to obtain the accumulated heat correcting data, and sent to the filter 30. The accumulated heat correcting data at the first position as counted from the line start is latched by the latch circuit 31 in response to a clock. Next, the accumulated heat correcting data at the second position as counted from the line start is input to the shift register 35. In response to a clock, the first accumulated heat correcting data is latched by the latch circuit 32, and the second accumulated heat correcting data is latched by the latch circuit 31.

The filtering process starts under the conditions that two sets of the first and second accumulated heat correcting data are latched by the shift register 35 and the third accumulated heat correcting data is input to the shift register 35. The first accumulated heat correcting data is directly sent to the summing point 41, and the second accumulated heat correcting data is multiplied by a coefficient K3 by the multiplier 38 and sent to the summing point 41. The third accumulated heat correcting data is multiplied by a coefficient K4 by the multiplier 37 and sent to the summing point 41. The summing point 41 adds three sets of the accumulated heat correcting data.

In the above manner, the first accumulated heat correcting data is used as it is, and the two sets of the accumulated heat correcting data on one side of the two heating elements are multiplied by the coefficients. These three sets of the accumulated heat correcting data are added together. Therefore, in addition to the heating history of the subject heating element, the heating history of adjacent heating elements can be taken into consideration. The data added at the summing point 41 is sent to the summing point 26 and added to the accumulated heat corrected data at the first position of one line to be presently printed.

While the fourth accumulated heat correcting data is input to the shift register 25, the first accumulated heat correcting data is latched by the latch circuit 33, the second accumulated heat correcting data is latched by the latch circuit 32, and the third accumulated heat correcting data is latched by the latch circuit 31. The second accumulated heat correcting data is used as it is and sent to the summing point 41, two sets of the first and third heat accumulated heat correcting data are multiplied by the coefficient K3, and the fourth accumulated heat correcting data is multiplied by the coefficient K4. These four sets of the accumulated heat correcting data are added together. Therefore, the second accumulated heat correcting data is adjusted by the first accumulated heat correcting data on one side and the second and fourth accumulated heat correcting data on the other side.

While the fifth accumulated heat correcting data is input to the shift register 25, the first accumulated heat correcting data is latched by the latch circuit 34, and the second accumulated heat correcting data is latched by the latch circuit 33. Further, the third accumulated heat correcting data is latched by the latch circuit 32, and the fourth accumulated heat correcting data is latched by the latch circuit 31.

The third accumulated heat correcting data latched by the latch circuit 32 is directly sent to the summing point 41.

Two sets of the first and fifth heat accumulated heat correcting data are multiplied by the coefficient K4 and sent to the summing point 41. Two sets of the second and fourth heat accumulated heat correcting data are multiplied by the coefficient K3 and sent to the summing point 41. Therefore, the third accumulated heat correcting data is adjusted by two sets of the accumulated heat correcting data respectively on the right and left sides.

Similarly, the fourth and following accumulated heat correcting data is adjusted by two sets of the accumulated heat correcting data respectively on the right and left sides. After the last accumulated heat correcting data is latched by the latch circuit 32 and the filtering calculation is performed, the filtering calculation for one line is completed.

Two sets of dummy data may be added before and after the accumulated heat correcting data of one line. In this case, the filtering calculation starts when the accumulated heat correcting data of the first dummy data is latched by the latch circuit 31. Although the accumulated heat correction is performed also for the dummy data, this dummy data is discarded before it is supplied to the thermal head. Since there are heating elements not contributing to image recording at opposite ends of the thermal head, dummy data corresponding in number to the number of these heating elements may be used. Although the corrected heat data of one line including a plurality of dummy data sets is supplied to the thermal head, the marginal heating elements are not supplied with power so that the dummy data is substantially discarded.

The invention is applicable to a color direct thermal printer, as described in U.S. Pat. No. 5,424,761, for printing a full-color image by sequentially developing colors in a cyan thermosensitive coloring layer, a magenta thermosensitive coloring layer, and a yellow thermosensitive coloring layer sequentially laminated on a support layer, starting from the uppermost thermosensitive coloring layer. For this color printer, the accumulated heat correction is performed for each color.

The, invention is also applicable to sublimation type thermal transfer recording using an ink film. In addition to a line printer, a serial printer with a moving thermal head may also be used. In the above embodiment, two line memories are used. However, since data read/write is performed alternately, one line memory may suffice. The accumulated heat correction calculation of this invention can be executed by a CPU.

Various modifications and changes of the invention are possible which should be construed as falling in the protective scope of this invention.

What is claimed is:

1. A method of correcting accumulated heat for a thermal printer having a thermal head with a plurality of heating elements disposed in line, the method comprising the steps of:

multiplying corrected heat data of an Nth line by a coefficient K1 to obtain first data of an (N+1)th line;

adding accumulated heat correcting data of the Nth line to said first data of the (N+1)th line in dot-to-dot correspondence, to obtain second data of the (N+1)th line;

multiplying said second data of the (N+1)th line by a coefficient K2 to obtain accumulated heat correcting data of the (N+1)th line, subtracting said accumulated heat correcting data of the (N+1)th line from said original heat data of the (N+1)th line to provide corrected heat data of the (N+1)th line, and applying the corrected heat data of the (N+1)th line to a head driver which drives the thermal head to print (N+1)th line.

2. A method according to claim 1, wherein prior to said adding step, said accumulated heat correcting data of the Nth line is subjected to a filtering calculation which determines the effect of accumulated heat in adjacent heating elements.

3. A method according to claim 2, wherein said filtering calculation uses five sets of said accumulated heat correcting data a group of adjacent lines of heating elements, including Nth line accumulated heat correcting data, two sets of said accumulated heat correcting data at a right side of said Nth line accumulated heat correcting data, and two sets of said accumulated heat correcting data at a left side of said Nth line accumulated heat correcting data; said Nth line accumulated heat correcting data is used as it is, two sets of said accumulated heat correcting data at first positions at the right and left sides are each multiplied by a coefficient K3; two sets of said accumulated heat correcting data at second positions at the right and left sides are each multiplied by a coefficient K4; and sum data of addition of these five sets is used as new Nth line accumulated heat correcting data.

4. An accumulated heat correction apparatus for a thermal printer having a thermal head with a plurality of heating elements disposed in line and a head driver for applying heat data to the thermal head, comprising:

means for correcting heat data to obtain corrected heat data by subtracting accumulated heat correcting data of an Nth line to be printed from original heat data of the Nth line, each said heating element being driven by the corrected heat data to record an image of an Nth line on a recording sheet;

first multiplying means for multiplying said corrected heat data of the Nth line by a coefficient K1 to obtain first data of (N+1)th line;

first adding means for adding the accumulated heat correcting data of the Nth line to said first data of the (N+1)th line in dot-to-dot correspondence, to obtain second data of said (N+1)th line;

line memory means for storing said second data of the (N+1)th line; and second multiplying means for multiplying said second data of said (N+1)th line read from said line memory means by a coefficient K2 for printing the (N+1)th line, to obtain accumulated heat correcting data of the (N+1) th line, means for subtracting said accumulated heat correcting data of the (N+1)th line from said original heat data at the (N+1)th line to obtain an accumulated heat correction signal for the (N+1)th line, and means for applying the heat correction signal of the (N+1)th line to the head driver which drives the thermal head to print the (N+1)th line.

5. An apparatus according to claim 4, wherein said line memory means includes first and second line memories each being switched alternately between reading and writing such that said second line memory writes said second data of the (N+1)th line while said first line memory reads said second data of the Nth line.

6. An apparatus according to claim 4, further comprising a filter provided between said second multiplying means and said first adding means for performing a filtering calculation of said second data, said filtering calculation determining the effects of accumulated heat in adjacent heating elements.

7. An apparatus according to claim 6, wherein said filter comprises:

a shift register for outputting five sets of said accumulated heat correcting data from a group of adjacent lines of heating elements including subject accumulated heat correcting data, two sets of said accumulated heat correcting data at a right side of said Nth line accumulated heat correcting data, and two sets of said accumulated heat correcting data at a left side of said Nth line accumulated heat correcting data;

third and fourth multiplying means for multiplying the two sets of said accumulated heat correcting data at first positions at the right and left sides by a coefficient K3;

fifth and sixth multiplying means for multiplying the two sets of said accumulated heat correcting data at second positions at the right and left sides by a coefficient K4; and second adding means for adding outputs of said third to sixth multiplying means and said Nth line accumulated heat correcting data; to obtain new Nth line accumulated heat correcting data.

* * * * *